US010788254B2

(12) United States Patent
Schroeder et al.

(10) Patent No.: US 10,788,254 B2
(45) Date of Patent: Sep. 29, 2020

(54) ROTATING HEAT CARRIER SYSTEM

(71) Applicant: Haier US Appliance Solutions, Inc., Wilmington, DE (US)

(72) Inventors: Michael Goodman Schroeder, Louisville, KY (US); Matthew Hunter, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 83 days.

(21) Appl. No.: 16/245,413

(22) Filed: Jan. 11, 2019

(65) Prior Publication Data

US 2020/0224950 A1 Jul. 16, 2020

(51) Int. Cl.

| | |
|---|---|
| ***F25D 3/00*** | (2006.01) |
| ***F28D 7/16*** | (2006.01) |
| *F28F 13/12* | (2006.01) |
| *F28F 3/02* | (2006.01) |
| *F28D 1/04* | (2006.01) |
| *F28F 1/24* | (2006.01) |
| *F28D 1/02* | (2006.01) |

(52) U.S. Cl.

CPC ..... *F25D 3/005* (2013.01); *F28D 7/1623* (2013.01); *F28D 1/024* (2013.01); *F28D 1/04* (2013.01); *F28F 1/24* (2013.01); *F28F 3/02* (2013.01); *F28F 13/12* (2013.01)

(58) Field of Classification Search

CPC ..... F25D 3/005; F25D 11/02; F25D 13/04; F25D 17/065; F28D 1/04; F28D 1/024; F28D 19/00; F28D 19/04; F28D 7/1623; F28F 3/02; F28F 13/12

See application file for complete search history.

(56) References Cited

U.S. PATENT DOCUMENTS

| | | | | |
|---|---|---|---|---|
| 3,804,155 A * | 4/1974 | Glicksman | ..... | F28D 19/045 165/5 |
| 4,185,687 A * | 1/1980 | Stockman | ..... | F28D 19/045 165/10 |
| 5,335,143 A | 8/1994 | Maling, Jr. et al. | | |
| 2018/0094869 A1 | 4/2018 | Reshetnyak | | |

* cited by examiner

*Primary Examiner* — Joseph F Trpisovsky
(74) *Attorney, Agent, or Firm* — Dority & Manning, P.A.

(57) ABSTRACT

A rotating heat carrier system includes a barrier having a first side portion and a second side portion. A plurality of disks is mounted to a shaft. A motor is coupled to the shaft. The motor is operable to rotate the shaft and the plurality of disks. The plurality of disks is at least partially positioned within the barrier. A first portion of each of the plurality of disks extends along a radial direction away from the first side portion of the barrier. A second portion of each of the plurality of disks extends along the radial direction away from the second side portion of the barrier.

19 Claims, 3 Drawing Sheets

ROTATING HEAT CARRIER SYSTEM

FIELD OF THE INVENTION

The present subject matter relates generally to heat transfer devices for appliances, such as refrigerator appliances.

BACKGROUND OF THE INVENTION

Refrigerators frequently include a freezer compartment and a fresh food compartment, which are partitioned from each other to store various foods at appropriate low temperatures. In "bottom mount" refrigerators, the freezer compartment is arranged beneath the fresh food compartment, and an icemaker is disposed in a thermally insulated subcompartment (also known as an "icebox") within one of the fresh food compartment doors. Such positioning of the icebox is convenient; however, the icebox must be cooled to below the freezing temperature of water to enable the icemaker to form ice.

Certain bottom mount refrigerators include air ducts between the freezer compartment and the icebox. Air from freezer compartment flows through the air ducts to the icebox in order to freeze water and enable operation of the icemaker. Such air ducts can require complex routing to flow air into the fresh food compartment door. In addition, air ducts can occupy a significant volume within the refrigerators.

BRIEF DESCRIPTION OF THE INVENTION

Aspects and advantages of the invention will be set forth in part in the following description, or may be apparent from the description, or may be learned through practice of the invention.

In a first example embodiment, a rotating heat carrier system includes a barrier having a first side portion and a second side portion. The first side portion is positioned opposite the second side portion on the barrier. The rotating heat carrier system also includes a shaft. A plurality of disks is mounted to the shaft such that each of the plurality of disks extends along a radial direction from the shaft. The plurality of disks is stacked on the shaft such that each of the plurality of disks is spaced from an adjacent pair of the plurality of disks along an axial direction on the shaft. A motor is coupled to the shaft. The motor is operable to rotate the shaft and the plurality of disks. The plurality of disks is at least partially positioned within the barrier. A first portion of each of the plurality of disks extends along the radial direction away from the first side portion of the barrier. A second portion of each of the plurality of disks extends along the radial direction away from the second side portion of the barrier.

In a second example embodiment, a refrigerator appliance includes a cabinet have a first chamber and a second chamber positioned within the cabinet. A rotating heat carrier system is positioned within the cabinet. The rotating heat carrier system includes a barrier positioned between the first and second chambers. The rotating heat carrier system also includes a shaft. A plurality of disks is mounted to the shaft such that each of the plurality of disks extends along a radial direction from the shaft. The plurality of disks is stacked on the shaft such that each of the plurality of disks is spaced from an adjacent pair of the plurality of disks along an axial direction on the shaft. A motor is coupled to the shaft. The motor is operable to rotate the shaft and the plurality of disks. The plurality of disks is at least partially positioned within the barrier. A first portion of each of the plurality of disks extends along the radial direction into the first chamber. A second portion of each of the plurality of disks extends along the radial direction into the second chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
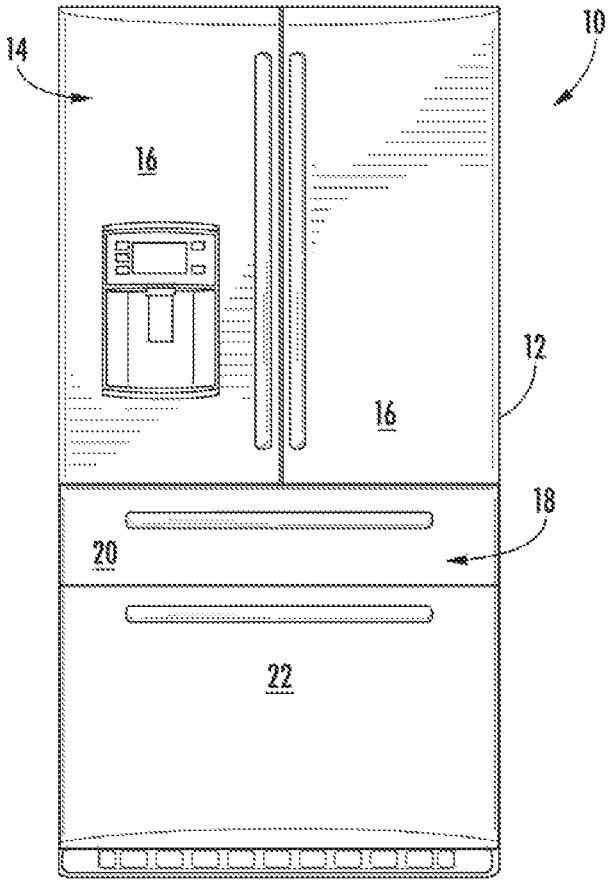
FIG. 1 is a front elevation view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an example embodiment of a refrigerator appliance 10 is depicted as an upright refrigerator having a cabinet or casing 12 that defines a number of internal storage compartments or chilled chambers. In particular, refrigerator appliance 10 includes upper fresh-food compartments 14 having doors 16 and lower freezer compartment 18 having upper drawer 20 and lower drawer 22. The drawers 20, 22 are "pull-out" type drawers in that they can be manually moved into and out of the freezer compartment 18 on suitable slide mechanisms. It will be understood that doors 16 may be considered part of casing 12 in certain example embodiments.

Refrigerator 10 is provided by way of example only. Other configurations for a refrigerator appliance may be used as well including appliances with only freezer compartments, only chilled compartments, or other combinations thereof different from that shown in FIG. 1. In addition, the rotating heat carrier of the present invention is not limited to appliances and may be used in other applications as well such as e.g., air-conditioning, electronics cooling devices, and others. Further, it should be understood that while the use of a rotating heat carrier to provide cooling within a refrigerator is provided by way of example herein, the present invention may also be used to provide for heating applications as well.

Figure 2:
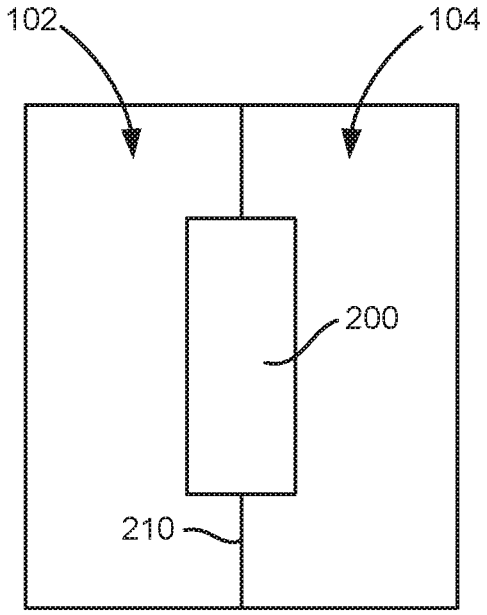
FIG. 2 is a schematic illustration of a rotating heat carrier system of the example refrigerator appliance of FIG. 1.

FIG. 2 is a schematic illustration of a rotating heat carrier system 200 of refrigerator 10. Rotating heat carrier system 200 is operable to transfer heat between a pair of the internal storage compartments or chilled chambers of refrigerator 10. For example, as shown in FIG. 2, rotating heat carrier system 200 may be positioned between a first chamber 102 and a second chamber 104 within casing 12. During operation, rotating heat carrier system 200 may transfer heat from first chamber 102 to second chamber 104 or vice versa.

First and second chambers 102, 104 may be any suitable chambers within casing 12. For example, first chamber 102 may be fresh-food compartment 14, and second chamber 104 may be freezer compartment 18. As another example, first chamber 102 may be fresh-food compartment 14, and second chamber 104 may be an ice making chamber or icebox (not shown) within one of doors 16.

Figure 3:
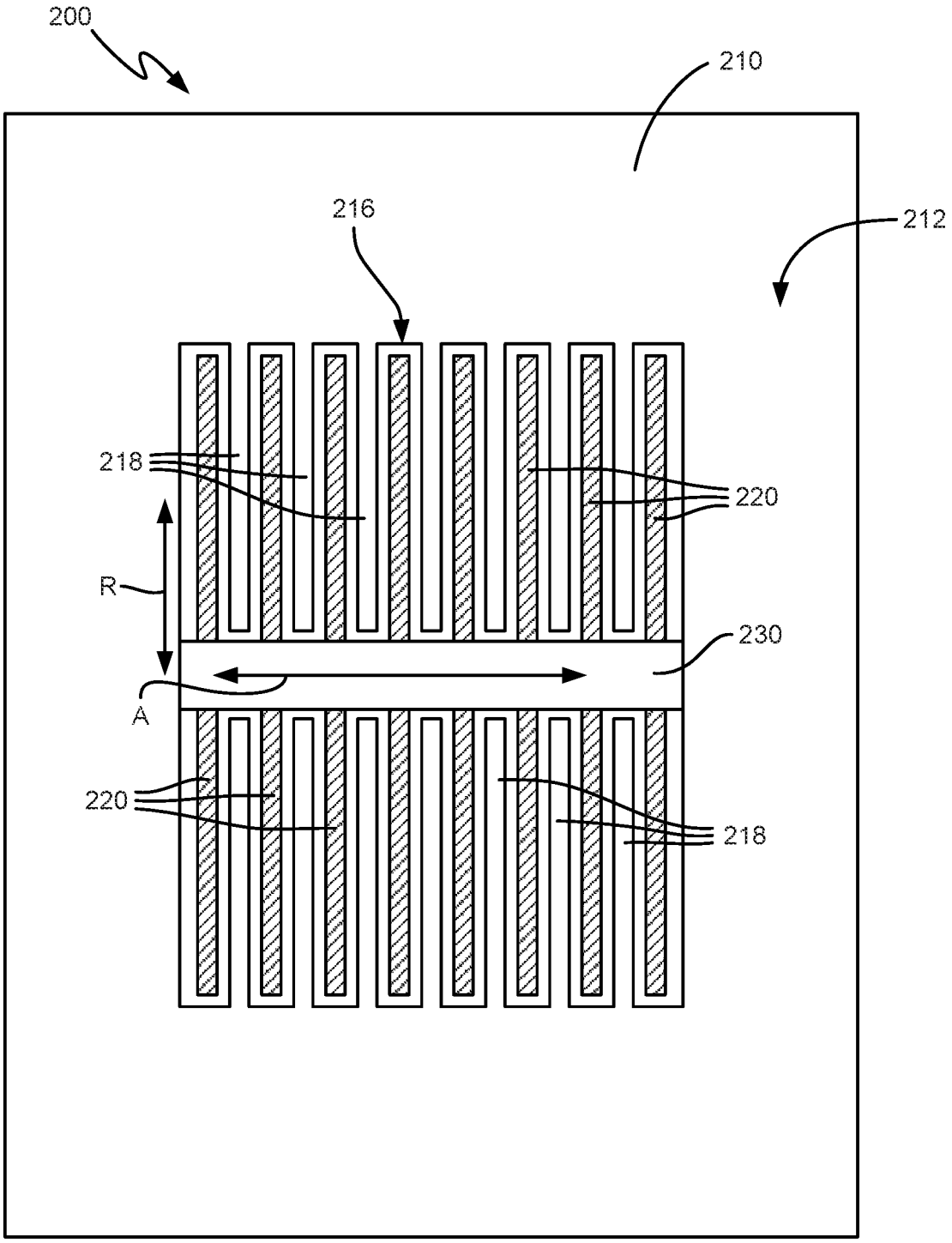
FIG. 3 is a side elevation view of the rotating heat carrier system of FIG. 2.
Figure 4:
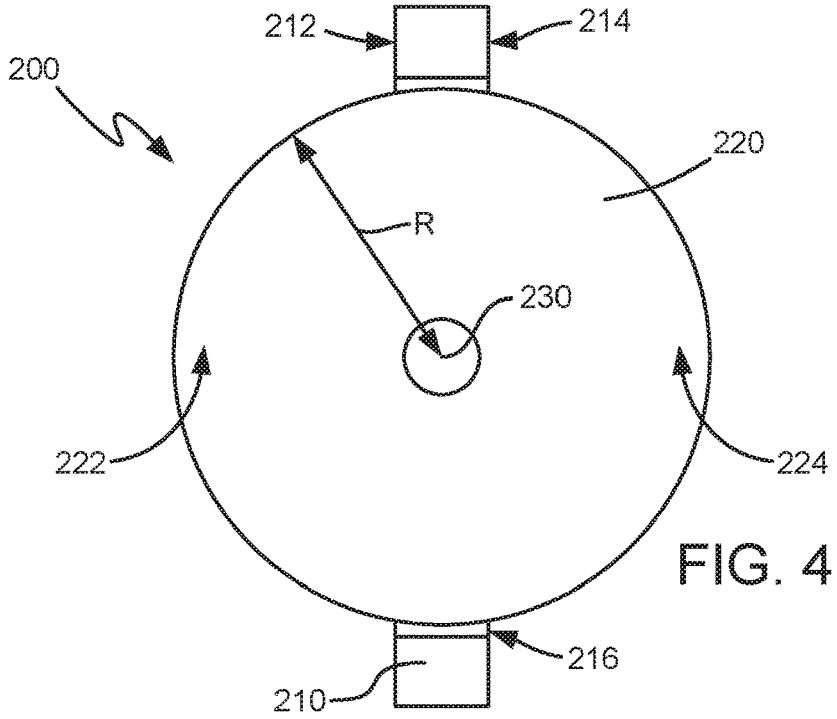
FIGS. 4 and 5 are section views of the rotating heat carrier system of FIG. 2.
Figure 5:
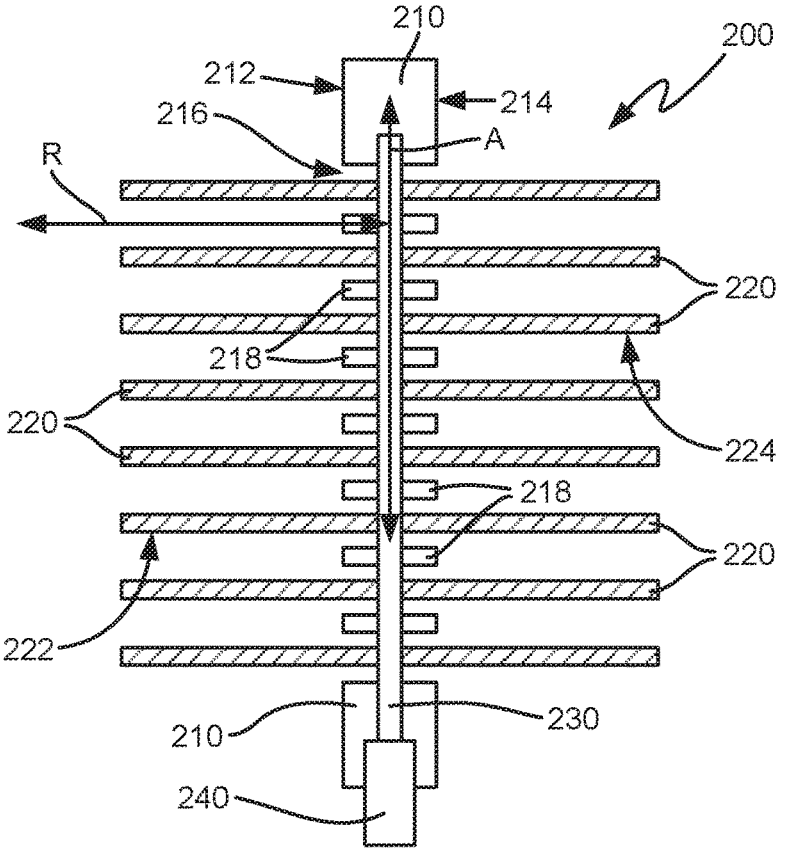

FIG. 3 is a side elevation view of rotating heat carrier system 200. FIGS. 4 and 5 are section views of rotating heat carrier system 200. As may be seen in FIGS. 3 through 5, rotating heat carrier system 200 includes a barrier 210. Barrier 210 has a first side portion 212 and a second side portion 214. First side portion 212 may be positioned opposite second side portion 214 on barrier 210. For example, first side portion 212 of barrier 210 may be positioned at and/or face first chamber 102, and second side portion 214 of barrier 210 may be positioned at and/or face second chamber 104. Barrier 210 may block or limit airflow between first and second chambers 102, 104.

Barrier 210 may be an insulated barrier, e.g., such that insulation within barrier 210 limits heat transfer between first and second side portions 212, 214 of barrier 210. As an example, barrier 210 may include suitable foam insulation, fiberglass insulation, vacuum panel insulation, etc. between first and second side portions 212, 214 of barrier 210. In such a manner, barrier 210 may limit heat transfer between first and second chambers 102, 104. However, as noted above and discussed in greater detail below, rotating heat carrier system 200 includes features for transferring heat through barrier 210 from first chamber 102 to second chamber 104 or vice versa.

With reference to FIGS. 3 through 5, rotating heat carrier system 200 includes a plurality of disks 220 and a shaft 230. Disks 220 are shown with hatch lines in FIG. 3 to assist with distinguishing disks 220 from other components of rotating heat carrier system 200. Disks 220 are mounted to shaft 230. In particular, each disk 220 may extend along a radial direction R from shaft 230. Disks 220 may also be stacked on shaft 230. In particular, each disk 220 may be spaced from an adjacent pair of disks 220 along an axial direction A on shaft 230. Thus, disks 220 may be distributed along the axial direction A on shaft 230.

Disks 220 are at least partially positioned within barrier 210. For example, barrier 210 may define a passage 216. Passage 216 may extend through barrier 210, e.g., between first and second side portions 212, 214 of barrier 210, and disks 220 may be at least partially positioned within barrier 210 at passage 216 of barrier 210. Disks 220 may carry heat through passage 216 between first and second chambers 102, 104, as discussed in greater detail below.

A first portion 222 of each disk 220 may extend along the radial direction R away from first side portion 212 of barrier 210. Thus, first portion 222 of each disk 220 may extend into and be positioned within first chamber 102. Conversely, a second portion 224 of each disk 220 may extend along the radial direction R away from second side portion 214 of barrier 210. Thus, second portion 224 of each disk 220 may extend into and be positioned within second chamber 104.

A motor 240 is coupled to shaft 230. Motor 240 is operable to rotate shaft 230. Thus, due to the connection between shaft 230 and disks 220, motor 240 is also operable to rotate disks 220. During operation of motor 240, disks 220 may rotate relative to barrier 210. Thus, e.g., disks 220 may rotate through barrier 210 between first and second chambers 102, 104 during operation of motor 240. Thus, it will be understood that the portion of each disk 220 corresponding to first portion 222 within first chamber 102 and the portion of each disk 220 corresponding to second portion 224 within second chamber 104 changes during operation of motor 240 due to rotation of disks 220.

Shaft 230 may be mounted for rotation about a horizontal axis, a vertical axis or a suitable angle between horizontal and vertical depending upon the arrangement of rotating heat carrier system 200. Motor 240 may also be spaced from first and second chambers 102, 104, e.g., to limit heating of first and second chambers 102, 104 during operation of motor 240. Thus, motor 240 may be located remote from first and second chambers 102, 104, and shaft 230 may couple motor 240 to disks 220.

Disks 220 are configured to transfer heat through barrier 210 when motor 240 rotates disks 220. Various heat transfer mechanism assists disks 220 with transferring heat through barrier 210. As an example, convection heat transfer between air within first chamber 102 and disks 220 may cool first portions 222 of disks 220. As motor 240 rotates disks 220, the cooled portion of disks 220 rotates through barrier 210 into second chamber 104. In turn, convection heat transfer between air within second chamber 104 and disks 220 may cool the air within second chamber 104. As another example, convection heat transfer between air within first chamber 102 and disks 220 may heat first portions 222 of disks 220. As motor 240 rotates disks 220, the heated portion of disks 220 rotates through barrier 210 into second chamber 104. In turn, convection heat transfer between air within second chamber 104 and disks 220 may heat the air within second chamber 104.

As may be seen from the above, rotating heat carrier system 200 may transfer energy across an air barrier, such as barrier 210. In particular, rotation of disks 220 transports thermal energy between locations on either side of barrier 210. Rotating heat carrier system 200 may efficiently and/or quietly operate within an associated appliance to transfer heat between two separate chambers.

To assist with blocking fluid flow and thus undesired heat transfer through passage 216, barrier 210 may include a plurality of fingers 218. Fingers 218 are positioned at passage 216 of barrier 210, and each finger 218 may be positioned between a respective pair of disks 220. In particular, fingers 218 may be sized such that the width of fingers 218 along the axial direction A results in only a small gap along the axial direction A between fingers 218 and disks 220. In addition, fingers 218 may be sized such that the length of fingers 218 along the radial direction R results in only a small gap along the radial direction R between fingers 218 and shaft 230. Thus, fingers 218 may be configured to block fluid flow through barrier 210 via passage 216. In particular, fingers 218 and disks 220 may collectively form a loose air seal within passage 216 to limit or block airflow between first and second chambers 102, 104 through passage 216.

Disks 220 may include a suitable number of disks. For example, disks 220 may include no less than four disks.

Such number of disks 220 may efficiently transfer heat during operation of rotating heat carrier system 200. Disks 220 may also be constructed of a suitable material. For example, disks 220 may be metal disks in certain example embodiments, e.g., to facilitate efficient heat transfer during operation of rotating heat carrier system 200. Conversely, disks 220 may be plastic disks in alternative example embodiments, e.g., to limit conductive heat transfer through disks 220 when rotating heat carrier system 200 is inactive.

The sizing of disks 220 may also be selected to facilitate heat transfer with air. For example, a thickness of each disk 220 along the axial direction R may be greater than a diameter of each disk 220 along the axial direction A. For example, the thickness of disks 220 may be no greater than a tenth of the diameter of disks 220. As another example, the thickness of disks 220 may be no greater than a twentieth of the diameter of disks 220. Such sizing of disks 220 may provide a large surface air for convective heat transfer with air while limiting a total mass of disks 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rotating heat carrier system, comprising:

a barrier having a first side portion and a second side portion, the first side portion positioned opposite the second side portion on the barrier;

a shaft;

a plurality of disks mounted to the shaft such that each of the plurality of disks extend along a radial direction from the shaft, the plurality of disks stacked on the shaft such that each of the plurality of disks is spaced from an adjacent pair of the plurality of disks along an axial direction on the shaft; and a motor coupled to the shaft, the motor operable to rotate the shaft and the plurality of disks, wherein the plurality of disks is at least partially positioned within the barrier, a first portion of each of the plurality of disks are extending along the radial direction away from the first side portion of the barrier, a second portion of each of the plurality of disks extending along the radial direction away from the second side portion of the barrier.

2. The rotating heat carrier system of claim 1, wherein the barrier defines a passage that extends through the barrier between the first and second side portions of the barrier, the plurality of disks at least partially positioned within the barrier at the passage of the barrier.

3. The rotating heat carrier system of claim 2, wherein the barrier comprises a plurality of fingers positioned at the passage of the barrier, each of the plurality of fingers positioned between a respective pair of the plurality of disks, the plurality of fingers configured to block fluid flow through the barrier between the first and second side portions of the barrier at the passage of the barrier.

4. The rotating heat carrier system of claim 1, wherein the plurality of disks are configured to transfer heat through the barrier when the motor rotates the plurality of disks.

5. The rotating heat carrier system of claim 4, wherein the barrier is positioned between a first chilled chamber and a second chilled chamber, the first side portion positioned adjacent the first chilled chamber, the second side portion positioned adjacent the second chilled chamber.

6. The rotating heat carrier system of claim 5, wherein the motor is spaced from the first and second chilled chambers.

7. The rotating heat carrier system of claim 1, wherein the plurality of disks comprises no less than four disks.

8. The rotating heat carrier system of claim 1, wherein the barrier is an insulated barrier.

9. The rotating heat carrier system of claim 1, wherein the plurality of disks comprises metal disks.

10. The rotating heat carrier system of claim 1, wherein the plurality of disks comprises plastic disks.

11. A refrigerator appliance, comprising:

a cabinet have a first chamber and a second chamber positioned within the cabinet;

a rotating heat carrier system positioned within the cabinet, the rotating heat carrier system comprising a barrier positioned between the first and second chambers, a shaft, a plurality of disks mounted to the shaft such that each of the plurality of disks extend along a radial direction from the shaft, the plurality of disks stacked on the shaft such that each of the plurality of disks is spaced from an adjacent pair of the plurality of disks along an axial direction on the shaft, and a motor coupled to the shaft, the motor operable to rotate the shaft and the plurality of disks, wherein the plurality of disks are at least partially positioned within the barrier, a first portion of each of the plurality of disks extending along the radial direction into the first chamber, a second portion of each of the plurality of disks extending along the radial direction into the second chamber.

12. The refrigerator appliance of claim 11, wherein the barrier defines a passage that extends through the barrier between the first and second chambers, the plurality of disks at least partially positioned within the barrier at the passage of the barrier.

13. The refrigerator appliance of claim 12, wherein the barrier comprises a plurality of fingers positioned at the passage of the barrier, each of the plurality of fingers positioned between a respective pair of the plurality of disks, the plurality of fingers configured to block fluid flow through the barrier between the first and second chambers at the passage of the barrier.

14. The refrigerator appliance of claim 11, wherein the plurality of disks are configured to transfer heat through the barrier when the motor rotates the plurality of disks.

15. The refrigerator appliance of claim 14, wherein the motor is spaced from the first and second chambers.

16. The refrigerator appliance of claim 11, wherein the plurality of disks comprises no less than four disks.

17. The refrigerator appliance of claim 11, wherein the barrier is an insulated barrier.

18. The refrigerator appliance of claim 11, wherein the plurality of disks comprises metal disks.

19. The refrigerator appliance of claim 11, wherein the plurality of disks comprises plastic disks.

* * * * *